US009650889B2

(12) United States Patent
Richards

(10) Patent No.: US 9,650,889 B2
(45) Date of Patent: May 16, 2017

(54) DOWNHOLE SIGNAL REPEATER

(71) Applicant: HALLIBURTON ENERGY SERVICES, INC., Houston, TX (US)

(72) Inventor: William Mark Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 119 days.

(21) Appl. No.: 14/413,906

(22) PCT Filed: Dec. 23, 2013

(86) PCT No.: PCT/US2013/077382

§ 371 (c)(1),
(2) Date: Jan. 9, 2015

(87) PCT Pub. No.: WO2015/099641

PCT Pub. Date: Jul. 2, 2015

(65) Prior Publication Data

US 2016/0273350 A1 Sep. 22, 2016

(51) Int. Cl.
*E21B 47/14* (2006.01)
*E21B 47/06* (2012.01)

(52) U.S. Cl.
CPC ..... *E21B 47/14* (2013.01); *E21B 47/06* (2013.01); *E21B 47/065* (2013.01)

(58) Field of Classification Search
CPC ..... E21B 47/091; E21B 47/101; E21B 47/14; E21B 47/082
USPC ..... 340/853.7, 855.6, 855.7, 856.4
See application file for complete search history.

(56) References Cited

U.S. PATENT DOCUMENTS

| | | | |
|---|---|---|---|
| 5,275,038 | A | 1/1994 | Sizer et al. |
| 5,419,188 | A | 5/1995 | Rademaker et al. |
| 5,579,842 | A | 12/1996 | Riley |
| 5,666,050 | A | 9/1997 | Bouldin et al. |
| 5,925,879 | A | 7/1999 | Hay |
| 6,018,501 | A | 1/2000 | Smith et al. |
| 6,075,461 | A | 6/2000 | Smith |
| 6,177,882 | B1 | 1/2001 | Ringgenberg et al. |
| 6,268,911 | B1 | 7/2001 | Tubel et al. |
| 6,269,198 | B1 | 7/2001 | Hodgson et al. |
| 6,288,975 | B1 | 9/2001 | Frederick et al. |

(Continued)

FOREIGN PATENT DOCUMENTS

| | | |
|---|---|---|
| EP | 1096271 | 5/2001 |
| EP | 1096272 | 5/2001 |

(Continued)

OTHER PUBLICATIONS

"Acoustic Telemetry System", Halliburton Testing and Subsea, 2010, 4 pages.

(Continued)

*Primary Examiner* — Kevin Kim
(74) *Attorney, Agent, or Firm* — Kilpatrick Townsend & Stockton LLP

(57) ABSTRACT

A repeater for use downhole in an oil or other well for detecting a sound or other signal that originates further downhole and generating a signal or indication perceptible uphole or at or above the rig floor. The signal may be a change in the weight of the rig measured at the rig floor caused by driving a counterweight against a stop at the repeater.

20 Claims, 3 Drawing Sheets

(56) References Cited

U.S. PATENT DOCUMENTS

| | | | | |
|---|---|---|---|---|
| 6,481,495 | B1 | 11/2002 | Evans | |
| 6,724,319 | B1 | 4/2004 | Knaack et al. | |
| 6,728,165 | B1 | 4/2004 | Roscigno et al. | |
| 6,769,805 | B2 | 8/2004 | Williams et al. | |
| 6,787,758 | B2 | 9/2004 | Tubel et al. | |
| 6,828,547 | B2 | 12/2004 | Tubel et al. | |
| 6,913,079 | B2 | 7/2005 | Tubel | |
| 6,915,686 | B2 | 7/2005 | Baustad | |
| 6,943,340 | B2 | 9/2005 | Tubel et al. | |
| 6,978,832 | B2 | 12/2005 | Gardner et al. | |
| 7,028,543 | B2 | 4/2006 | Hardage et al. | |
| 7,040,390 | B2 | 5/2006 | Tubel et al. | |
| 7,054,011 | B2 | 5/2006 | Zhu et al. | |
| 7,201,221 | B2 | 4/2007 | Tubel et al. | |
| 7,201,231 | B2 * | 4/2007 | Chaplin | E21B 47/18 166/177.2 |
| 7,219,729 | B2 | 5/2007 | Bostick, III et al. | |
| 7,228,900 | B2 | 6/2007 | Schultz et al. | |
| 7,240,738 | B2 | 7/2007 | Pendleton | |
| 7,245,382 | B2 | 7/2007 | Ronnekleiv | |
| 7,254,999 | B2 | 8/2007 | Bostick, III | |
| 7,278,480 | B2 | 10/2007 | Longfield et al. | |
| 7,284,606 | B2 | 10/2007 | Coronado | |
| 7,357,021 | B2 | 4/2008 | Blacklaw | |
| 7,417,920 | B2 | 8/2008 | Hahn et al. | |
| 7,436,320 | B2 | 10/2008 | Miller, Jr. | |
| 7,565,834 | B2 | 7/2009 | Adnan et al. | |
| 7,740,064 | B2 | 6/2010 | McCoy et al. | |
| 7,797,996 | B2 | 9/2010 | Bostick, III | |
| 7,857,066 | B2 | 12/2010 | DiFoggio et al. | |
| 7,881,155 | B2 | 2/2011 | Close | |
| 7,932,834 | B2 | 4/2011 | Beique et al. | |
| 7,946,341 | B2 | 5/2011 | Hartog et al. | |
| 7,982,632 | B2 | 7/2011 | Miller, Jr. | |
| 7,997,340 | B2 | 8/2011 | Bostick, III et al. | |
| 8,109,333 | B2 | 2/2012 | Yee | |
| 8,237,443 | B2 | 8/2012 | Hopmann et al. | |
| 8,430,163 | B2 | 4/2013 | Dupont | |
| 2001/0042617 | A1 | 11/2001 | Beck et al. | |
| 2002/0092649 | A1 | 7/2002 | Bixenman et al. | |
| 2002/0104652 | A1 | 8/2002 | Cole et al. | |
| 2003/0102980 | A1 | 6/2003 | Koro et al. | |
| 2003/0205083 | A1 | 11/2003 | Tubel et al. | |
| 2004/0043501 | A1 | 3/2004 | Means et al. | |
| 2004/0156265 | A1 | 8/2004 | Lavrut et al. | |
| 2004/0163809 | A1 | 8/2004 | Mayeu et al. | |
| 2004/0194958 | A1 | 10/2004 | Mayeu et al. | |
| 2005/0012036 | A1 | 1/2005 | Tubel et al. | |
| 2005/0062979 | A1 | 3/2005 | Zhu et al. | |
| 2005/0263279 | A1 | 12/2005 | Vachon et al. | |
| 2006/0081413 | A1 | 4/2006 | Minto | |
| 2007/0012460 | A1 | 1/2007 | Coronado | |
| 2007/0139217 | A1 | 6/2007 | Beique et al. | |
| 2007/0285274 | A1 * | 12/2007 | Esmersoy | E21B 21/08 340/853.5 |
| 2008/0264631 | A1 | 10/2008 | Mendez et al. | |
| 2008/0294344 | A1 | 11/2008 | Sugiura | |
| 2009/0034368 | A1 | 2/2009 | Johnson | |
| 2009/0071645 | A1 | 3/2009 | Kenison et al. | |
| 2009/0128141 | A1 | 5/2009 | Hopmann et al. | |
| 2009/0188665 | A1 | 7/2009 | Tubel et al. | |
| 2009/0199630 | A1 | 8/2009 | DiFoggio et al. | |
| 2009/0201764 | A1 | 8/2009 | Liu | |
| 2009/0301184 | A1 | 12/2009 | Irani et al. | |
| 2010/0013663 | A1 | 1/2010 | Cavender et al. | |
| 2010/0018303 | A1 | 1/2010 | Bostick, III | |
| 2010/0166358 | A1 | 7/2010 | Homa et al. | |
| 2010/0303426 | A1 | 12/2010 | Davis | |
| 2010/0309019 | A1 | 12/2010 | Shah et al. | |
| 2011/0163891 | A1 | 7/2011 | Wilson et al. | |
| 2011/0280105 | A1 | 11/2011 | Hall et al. | |
| 2012/0037360 | A1 | 2/2012 | Arizmendi, Jr. et al. | |
| 2012/0046866 | A1 | 2/2012 | Meyer et al. | |
| 2012/0080231 | A1 | 4/2012 | Radford et al. | |
| 2012/0147924 | A1 | 6/2012 | Hall | |
| 2012/0152562 | A1 | 6/2012 | Newton et al. | |
| 2012/0175135 | A1 | 7/2012 | Dyer et al. | |
| 2012/0176250 | A1 | 7/2012 | Duncan et al. | |
| 2012/0211231 | A1 | 8/2012 | Erkol et al. | |
| 2012/0256635 | A1 | 10/2012 | Gissler | |
| 2012/0286967 | A1 * | 11/2012 | Alteirac | E21B 47/12 340/853.7 |
| 2013/0016979 | A1 | 1/2013 | Duncan et al. | |
| 2013/0021874 | A1 | 1/2013 | Hartog et al. | |
| 2013/0075161 | A1 | 3/2013 | Yang | |
| 2013/0087328 | A1 | 4/2013 | Maida, Jr. et al. | |
| 2014/0014329 | A1 | 1/2014 | Radford et al. | |
| 2014/0251603 | A1 | 9/2014 | Raducanu et al. | |
| 2015/0077265 | A1 * | 3/2015 | Gao | E21B 17/10 340/853.7 |
| 2015/0167430 | A1 | 6/2015 | Purkis et al. | |

FOREIGN PATENT DOCUMENTS

| | | |
|---|---|---|
| EP | 1096273 | 5/2001 |
| GB | 2364380 | 1/2002 |
| GB | 2436473 | 9/2007 |
| WO | 9850681 | 11/1998 |
| WO | 9857030 | 12/1998 |
| WO | 03017538 | 2/2003 |
| WO | 2015069214 | 5/2015 |
| WO | 2015102582 | 7/2015 |
| WO | 2015112127 | 7/2015 |

OTHER PUBLICATIONS

"Bumper Spring with Collet Latch", Ferguson Bearegard, 2012, 1 page.

"EM Telemetry Tool for Deep Well Drilling Applications", Deep Trek Program Solicitation, E-Spectrum Technologies, Inc., 2 pages.

"Fiber Optic Sensing Technologies for Well Monitoring to Reservoir Management", Pinanacle, 2012, 7 Pages.

"Permanent Downhole Monitoring", Weatherford, 2006, 16 pages.

"Permanent Downhole Monitoring Solutions", Promore, Core Lab Reservoir Optimization www.promore.com, 2 pages.

"SureView Real-Time Fiber-Optic Compaction Monitoring System", The SureView RTCM system Baker Hughes, 2010, 4 pages.

Andren et al., "Integrated Ocean Drilling Program", Expedition 347 Scientific Prospectus, 61 pages.

Camwell et al., "Acoustic Telemetry, with Multiple Nodes in Drillstring, used to Achieve Distributed MWD", Innovating While Drilling, Mar./Apr. 2009, pp. 1-6.

Dria , "E&P Applications of Fiber Optic Technologies", Myden Energy Consulting PLLC, May 2012, 47 pages.

Fernandez et al., "Integrated drilling system using mud actuated down hole hammer as primary engine", Novatek, Report #34365R05, May 1996, 35 pages.

Harper et al., "Advanced Acoustic Telemetry System Provides Real-time Data Acquisition that Increases Efficiency in Well Testing Operations", Offshore Technology Conference, May 5-8, 2003, 16 pages.

Lienau , "Direct-Use Downhole Pumps", Geo-Heat Center Quarterly Bulletin vol. 8, No. 3, 1984, 7 Pages.

International Patent Application No. PCT/US2013/077382, "International Search Report and Written Opinion", Sep. 24, 2014, 13 pages.

Skinner et al., "Downhole Fiber-optic Sensing: The Oilfield Service Provider's Perspective", Halliburton Energy Services, Fiber Optic Sensor Technology and Applications III, Proc. of SPIE vol. 5589, 2004, pp. 206-220.

Wassermann et al., "How High-Speed Telemetry Affects the Drilling Process", JPT, Jun. 2009, 4 pages.

* cited by examiner

DOWNHOLE SIGNAL REPEATER

CROSS-REFERENCE TO RELATED APPLICATIONS

This is a U.S. national phase under 35 U.S.C. 371 of International Patent Application No. PCT/US2013/077382, titled "Downhole Signal Repeater" and filed Dec. 23, 2013, the entirety of which is incorporated herein by reference.

TECHNICAL FIELD

This disclosure relates to deep water and other oil wells and the communication of information from the wells to the surface.

BACKGROUND

Drilling, preparing for extraction and extraction of hydrocarbons from wells require awareness of location, condition or other information from the bottom and other intermediate points in the well. Some of such data may be provided by listening to sound traveling to the surface, but sounds from deep wells often do not reach the surface or are so attenuated as to be inaudible at the surface. Other signals or forms of data transfer likewise may not reach the surface.

Signals can be transmitted from a point in a well to the surface or another location on electrical or optical fiber cable, but in some situations such alternatives are prohibitively expensive or otherwise impractical or impossible.

BRIEF DESCRIPTION OF THE DRAWINGS

Illustrative embodiments of the present disclosure are described in detail below with reference to the following drawing figures.

DETAILED DESCRIPTION

The subject matter of embodiments of this disclosure is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

A relatively inexpensive repeater may be positioned in a well to detect events or conditions deeper in the well such as sounds, vibrations, pressure conditions, or changes or other events or conditions perceptible with a sensor. The repeater then transmits a signal or signals to the rig floor or another desired uphole location.

Figure 1:
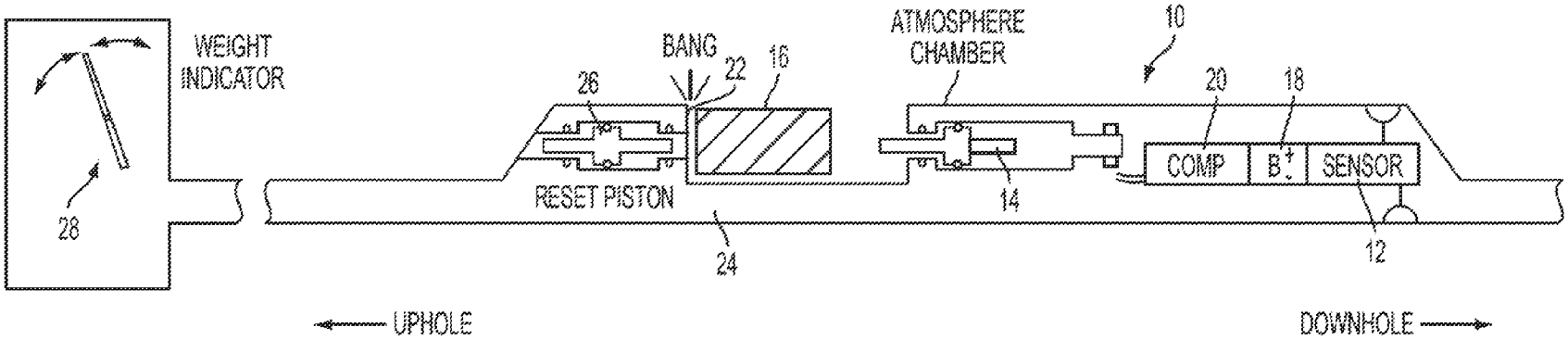
FIG. 1 is a schematized diagram of a repeater for use in a well.

FIG. 1 depicts a repeater 10 having a sensor 12 that generates a signal that actuates a pushing device such as an actuator, solenoid or piston 14 that pushes a mass such as a shuttle or counterweight 16. The counterweight 16 is driven into a stop 22 coupled to a mandrel 24 or other well structure with sufficient force to cause a discernible event at the well surface, such as a "bobble" of a weight indicator gauge 28.

Actuation of the piston 14 may involve, in addition to the sensor 12, a power source such as a battery 18 and optional computational circuitry 20 for outputting a signal that will actuate the piston 14 or another driver to cause the counterweight 16 to impact stop 22 with sufficient force to be detected uphole. A second device for moving the counterweight 16 such as a solenoid or reset piston 26 may be utilized to automatically return the counterweight 16 to its rest position to prepare it for repetition of another signal.

The sensor 12 may be a microphone or other sound sensor if the signal to be repeated is a sound. Other sensors such as strain gauges, pressure gauges, temperature gauges, hydrophones, accelerometers or other sensors that detect events or conditions may also be usable with the other components described here, depending on the signal desired to be communicated through the well.

The repeater 10 may be controlled by an operator on the rig floor. The sensor 12 may detect a control signal from the surface to turn the repeater 10 on, turn the repeater 10 off, change the strength of the return signal or otherwise control the repeater 10. For instance, the operator may send a control signal down the tubing to the sensor 12. The operator may also or alternatively send a control signal down the annulus to the sensor 12. Among other alternatives, the control signal may be an acoustic signal, a pressure signal (a pulse or series of sustained pressure holds), a series of tension and compression read by stain gauges in the mandrel, up and down motion read by accelerometers, or a dropped ball from surface with an RFID tag or magnet.

The simplest operation of the repeater 10 of FIG. 1 involves receipt of a sound or other signal that is treated as a single event or pulse and actuation once of the piston 14 to drive the counterweight 16 against the stop 22.

Figure 2:
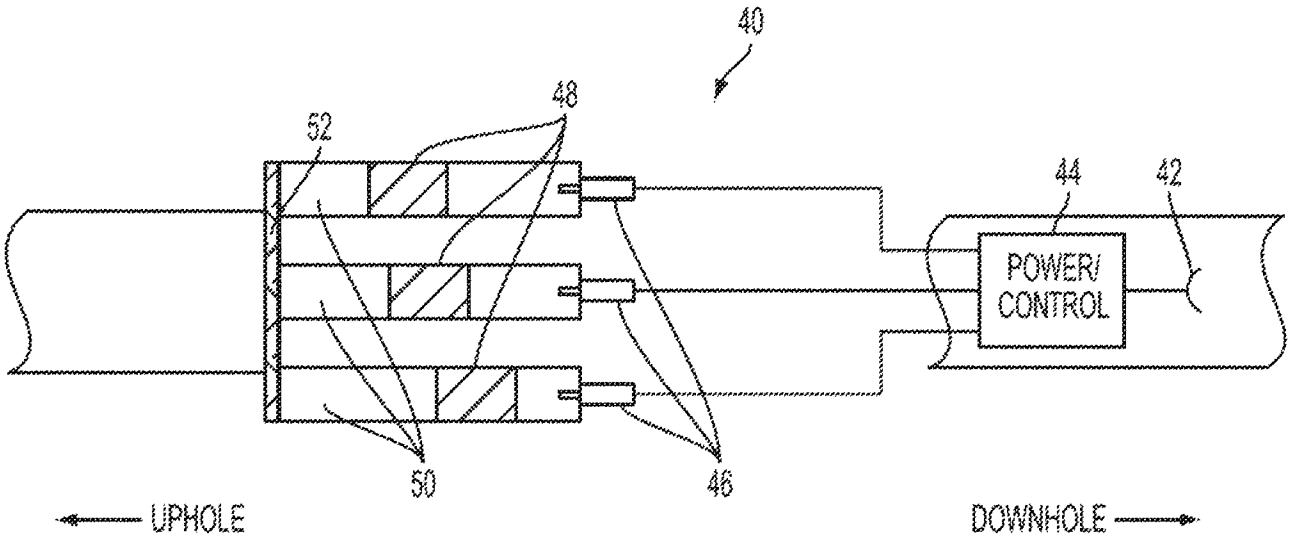
FIG. 2 is a schematized diagram of a repeater for use in a well that includes an array of transmission units.

Rather than a single large counterweight 16, multiple weights in tracks can be used to create a distinctive pattern of signals that may be more easily recognized at the surface because of the pattern. FIG. 2 depicts such an embodiment in schematized form.

Such multi-track repeater 40 uses a sensor or sensors 42 coupled to power and control circuitry 44 that triggers pistons 46 that strike or drive counterweights 48 that travel in tracks 50 to strike a stop 52 or multiple stops (not shown).

In this embodiment 40, a downhole sound or other event or condition detected by sensor 42 is received by the powered control circuit 44 that actuates multiple pistons 46 to drive counterweights 48 in tracks 50 simultaneously or in a pattern. Such a pattern may be, for example, two strikes closely spaced in time followed by a third strike after a time interval greater than the interval between the first two impacts. Numerous other "firing patterns" of pistons 44 driving counterweights 48 can be used, for instance, (1) in order to communicate more about the received sound (or other detected event or condition) than just its receipt, or (2) in order to send a signal uphole that can be more easily differentiated from "noise."

Figure 4:
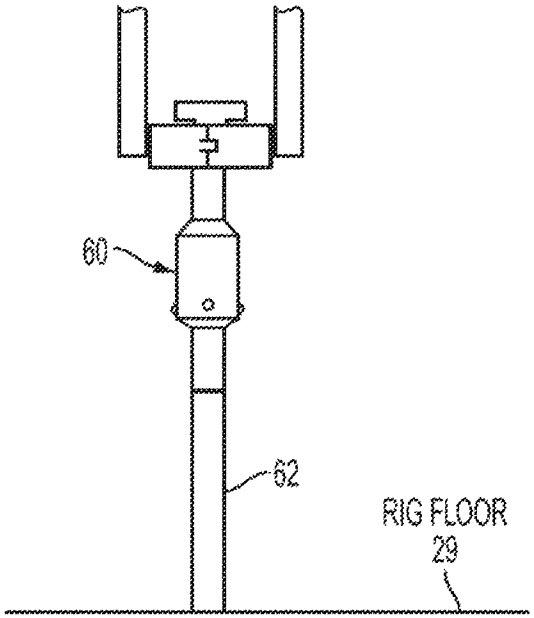
FIG. 4 is an enlarged, schematized view of the signal receiving apparatus shown in FIG. 3.
Figure 3:
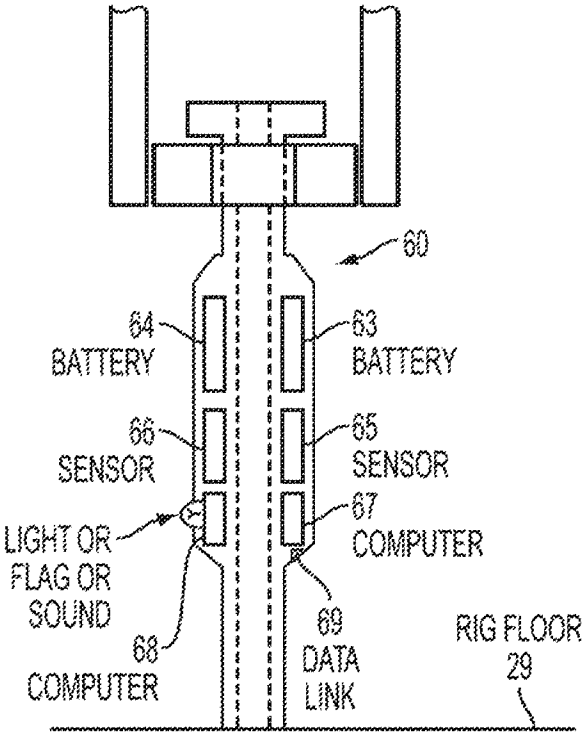
FIG. 3 is a side view of a signal receiving apparatus above a rig floor.

The signal transmitted to the surface or other area above the rig floor (not shown in FIGS. 1 and 2) may be heard by workers or may be received on existing equipment such by causing a "bobble" on a weight indicator 28 (FIG. 1). Alternatively, such a signal may be received by a dedicated receiver, an exemplary one of which is depicted in FIGS. 3 and 4.

Such a receiver 60 may be located at the top of a work string 62. As shown in FIG. 3, the receiver 60 may include a power source such as a battery 64, a sensor 66 and a light, flag or sound production device 68 that is perceptible by a rig operator or detectable by another means at or near the rig floor 29. Alternatively, or additionally, receiver 60 may include a power source such as a battery 64, a sensor 65 and computational circuitry 67, including a data link port or Wi-Fi capability 69 so that data can be monitored contemporaneously or stored for later analysis or both.

In situations where the depth of the sound or other signal source means that one repeater 10 or 40 cannot or may not produce a sufficiently strong repeated signal for the repeated signal to be reliably detected at or near the rig floor 29, one or more additional repeaters may be utilized at intervals within the well over which repeated signals can be reliably transmitted.

Different arrangements of the components depicted in the drawings or described here, as well as components and steps not shown or described are possible. Similarly, some features and subcombinations are useful and may be employed without reference to other features and subcombinations. Embodiments of the disclosure have been described for illustrative and not restrictive purposes, and alternative embodiments will become apparent to readers of this patent. Accordingly, the present disclosure is not limited to the embodiments described here or depicted in the drawings, and various embodiments and modifications can be made without departing from the scope of the claims below.

For instance, if a repeater 10 (FIG. 1) or 40 (FIG. 2) is positioned generally vertically with the sensor 12 at the bottom (the downhole end of the repeater 10 or 40), gravity alone may return the counterweight 16 or counterweights 48 to their rest positions. However, the repeater 10 or 40 may be oriented relatively horizontally, or there may be other structures or conditions, so that gravity may not return the counterweights 16 or 48 to their rest positions. Moreover, while the repeater 10 or 40 may be oriented so that the counterweights 16 or 48 travel uphole when actuated, in some instances it may be desirable for the counterweights 16 or 48 to move downhole when actuated because, for instance, it is desired that the weight indicator 28 (FIG. 1) register a greater weight when the repeater 10 is actuated and the counterweight 16 strikes the stop 22.

Other means for "resetting" the positions of counterweights 16 or 48 are also possible, including one or more springs such as a helical spring (not shown) that permits counterweight 16 or counterweights 48 travel until impact with the stop 22 or stop 52 but that then pulls the counterweights back to their rest positions.

Other configurations of the piston 14 and counterweight 16 are also possible. For instance, it may be possible in some circumstances to use a piston 14 (FIG. 1) or pistons 46 (FIG. 2) with sufficient mass and stroke that separate counterweights are not needed. In such a configuration, actuation of piston 14 or 46 travel alone or actuation of the piston and direct impact of piston 14 with stop 22 or of pistons 46 with stop 52 may cause an adequate "bobble" or other event at the rig floor 29 or at an uphole repeater to achieve the desired repetition of a downhole signal or event.

Similarly, different means may be used to cause counterweights 16 and 48 to impact their respective stops 22 and 52, such as, but not limited to, compressed or pressurized fluid, electromagnetic field propulsion, and gravitational attraction.

In some aspects, a downhole repeater, method or system receives, amplifies, repeats or transmits according to one or more of the following examples.

EXAMPLE #1

A repeater or downhole system for use in a well to detect a sound, condition or signal in the well and communicate that detection uphole can include a sensor, actuator and control circuitry. The sensor can detect an in-well sound, condition or signal. The actuator can generate a perceptible signal or physical change. The control circuitry for detecting the in-well sound, condition or signal can be coupled to the sensor and can actuate the actuator in response to the in-well sound, condition or signal.

EXAMPLE #2

The repeater or system of Example #1 may feature a stop and a counterweight to be driven by the actuator against the stop from a rest position.

EXAMPLE #3

The repeater or system of Examples #1-2 may feature an actuator that includes a drive piston.

EXAMPLE #4

The repeater or system of Examples #1-2 may feature a reset piston for returning the counterweight to the rest position after it has been driven by the drive piston.

EXAMPLE #5

The repeater or system of Examples #1-4 may feature control circuitry that turns the repeater or system on and off, or that otherwise controls the repeater or system, in response to control signals.

EXAMPLE #6

The repeaters or systems of Examples #1-5 may feature a sensor that is a microphone.

EXAMPLE #7

The repeaters or systems of Examples #1-6 may feature sensor that is capable of sensing pressure.

EXAMPLE #8

The repeaters or systems of Examples #1-7 may feature a sensor that is or includes an accelerometer.

EXAMPLE #9

The repeaters or systems of Examples #1-8 may feature a sensor that is or includes a strain gauge.

EXAMPLE #10

The repeaters or systems of Examples #1-9 may feature a sensor that is or includes a hydrophone.

EXAMPLE #11

A repeater for use in a well to detect a sound, condition or signal in the well and communicate that detection uphole may include a sensor, multiple actuators and control circuitry. The sensor may detect the in-well sound, condition or signal. The actuators can generate a perceptible signal or physical change. The control circuitry can be coupled to the sensor and the actuators and can actuate the actuators when the in-well sound, condition or signal is received by the sensor.

EXAMPLE #12

The repeater of Example #11 can actuate the actuators so that each of the actuators drives one counterweight against one stop. The control circuitry can control the time intervals between the activation of the actuators according to a predetermined pattern.

EXAMPLE #13

The repeater of Examples #11 and 12 may feature one or more actuators that are drive pistons.

EXAMPLE #14

The repeater of Examples #11-13 may feature for each counterweight a reset piston for returning the counterweight to a rest position after it has been driven by a drive piston.

EXAMPLE #15

The repeater of Examples #1-14 may feature a power source for the sensor, circuitry and actuators.

EXAMPLE #16

The repeaters of Examples #1-4 and 11-14 may also feature control circuitry for controlling operation of the repeater in response to control signals received by the sensor.

EXAMPLE #17

The repeaters of Examples #1-16 may feature a sensor that is one or more of a microphone, pressure sensor, accelerometer, strain gauge or hydrophone.

EXAMPLE #18

The repeaters or systems of Examples #1-17 may feature a receiver for use proximate a rig floor, and the receiver may include a receiver sensor, a power source, and on output device.

EXAMPLE #19

The repeater or systems of Example #18 may feature a receiver sensor that is one or more of a microphone, pressure sensor, accelerometer, strain gauge or hydrophone.

EXAMPLE #20

The repeaters or systems of Example #18 may feature an output device generates a signal that is visible or audible. Such a visible signal may be produced, without limitation, by a meter, a light-emitting component such as a laser, a LED, or an incandescent, florescent or other lamp. Such an audible signal may be produced by a bell, a buzzer, a speaker or any other device capable of generating sound.

EXAMPLE #21

A method of receiving at a rig floor information from deep within a well may utilize a repeater and well equipment. The repeater may be positioned in the well intermediate the rig floor and a location deeper in the well about which information is desired. The well equipment may be manipulated in the well to cause a first signal to emanate from the location deeper in the well about which information is desired. The repeater then may receive the first signal and transmit a second signal to the rig floor.

That which is claimed is:

1. A repeater for use in a well to detect a sound, condition or signal in the well and communicate that detection uphole, the repeater comprising:

a. a sensor for detecting the in-well sound, condition or signal;

b. an actuator for generating a perceptible signal or physical change;

c. control circuitry coupled to the sensor and the actuator to actuate the actuator when the in-well sound, condition or signal is received by the sensor; and d. a counterweight to be driven by the actuator against a stop from a rest position.

2. The repeater of claim 1, wherein the actuator comprises a drive piston.

3. The repeater of claim 1, further comprising a reset piston for returning the counterweight to the rest position after it has been driven by the drive piston.

4. The repeater of claim 1, wherein the control circuitry turns the repeater on and off in response to control signals.

5. The repeater of claim 1, wherein the sensor comprises a microphone or other sound sensor.

6. The repeater of claim 1, wherein the sensor comprises a pressure sensor.

7. The repeater of claim 1, wherein the sensor comprises an accelerometer.

8. The repeater of claim 1, wherein the sensor comprises a strain gauge.

9. The repeater of claim 1, wherein the sensor comprises a hydrophone.

10. A repeater for use in a well to detect a sound, condition or signal in the well and communicate that detection uphole, the repeater comprising:

a. a sensor for detecting the in-well sound, condition or signal;

b. a plurality of actuators for generating a perceptible signal or physical change;

c. control circuitry coupled to the sensor and the actuators to actuate the actuators when an in-well sound, condition or signal is received by the sensor, wherein each of the plurality of actuators drives one counterweight against one stop.

11. The repeater of claim 10, wherein the control circuitry controls the time intervals between the activation of the actuators according to a predetermined pattern.

12. The repeater of claim 11, wherein each actuator comprises a drive piston.

13. The repeater of claim 12, further comprising a reset piston for returning the each of the counterweights to the rest position after it has been driven by each drive piston.

14. The repeater of claim 10, further comprising a power source for the sensor, circuitry and actuators and wherein the control circuitry controls operation of the repeater in response to control signals received by the sensor.

15. The repeater of claim 10, wherein the sensor comprises one of a microphone, pressure sensor, accelerometer, strain gauge or hydrophone.

16. The repeater of claim 1, further comprising a receiver for use proximate a rig floor, the receiver comprising a receiver sensor, a power source, and on output device.

17. The repeater of claim 16, wherein the receiver sensor comprises one of a microphone, pressure sensor, accelerometer, strain gauge or hydrophone.

18. The repeater of claim 16, wherein the output device generates a signal that is visible or audible.

19. A method of receiving at a rig floor information from deep within a well, comprising:

a. providing a repeater in the well intermediate the rig floor and a location deeper in the well about which information is desired;

b. manipulating a portion of well equipment in the well to cause a first signal to emanate from the location deeper in the well about which information is desired;

c. receiving the first signal with the repeater, the first signal causing an actuator of the repeater to drive a counterweight against a stop to generate a second signal; and d. transmitting the second signal to the rig floor.

20. The method of claim 19, wherein the first signal further causes at least one additional actuator of the repeater to drive at least one additional counterweight against the stop to generate the second signal, wherein the counterweight and the at least one additional counterweight are driven in a pattern by the actuators.

* * * * *